United States Patent [19]

Shelton

[11] 4,177,895

[45] * Dec. 11, 1979

[54] MOISTURE STABILIZED PACKAGE

[76] Inventor: Marcus H. Shelton, 613 Morrell, Baytown, Tex. 77520

[ * ] Notice: The portion of the term of this patent subsequent to Jun. 20, 1995, has been disclaimed.

[21] Appl. No.: 908,870

[22] Filed: May 23, 1978

Related U.S. Application Data

[62] Division of Ser. No. 487,895, Jul. 12, 1974, Pat. No. 4,095,692.

[51] Int. Cl.[2] ..... B65D 19/02

[52] U.S. Cl. ..... 206/386; 206/497; 229/15; 53/305; 53/286

[58] Field of Search ..... 206/386, 497; 229/3.1, 229/15; 53/29, 30 R, 30 S, 286, 287

[56] References Cited

U.S. PATENT DOCUMENTS

| | | | |
|---|---|---|---|
| 1,425,574 | 8/1922 | Boyer | 206/497 |
| 3,089,589 | 5/1963 | Fallert | 229/15 X |
| 3,406,052 | 10/1968 | Peters | 156/198 |
| 3,670,880 | 6/1972 | Burleson | 206/497 |
| 3,796,307 | 3/1974 | McKinney | 206/521 |
| 3,834,607 | 9/1974 | Muyll | 229/14 BL |

*Primary Examiner*—Joseph M. Moy
*Attorney, Agent, or Firm*—Myron B. Kurtzman

[57] ABSTRACT

A package exhibiting high strength for containment during storage and shipping and stability thereof in humidity variations. This package comprises a multi-cell container prepared from a partially corrugated first material having peaks and flutes, a polymeric film encompassing the outermost peripheral surface of said container and a cover for said container and which cover is prepared from at least a partially corrugated second material having peaks and flutes.

12 Claims, 3 Drawing Figures

MOISTURE STABILIZED PACKAGE

This is a division of application Ser. No. 487,895, filed July 12, 1974, now U.S. Pat. No. 4,095,692.

The present invention relates to a corrugated material forming a multi-cell container encompassed by a polymeric film and a cover therefor and which collectively constitute a novel package. More specifically, this invention relates to a novel package which is substantially stabilized against varying moisture conditions.

Corrugated packages (cartons or containers) are a standard item in commerce for transporting bulk material. For example, corrugated bulk boxes are widely used in the chemical industry for shipment of granular, powdered or elastomeric solids. Notwithstanding the fact that corrugated board is ideal from an economic and convenience, one of the major disadvantages is that said board weakens rapidly in warehouse storage. This weakening is evidenced by bulged, split or crushed packages and by the subsequent collapse of warehouse stacks. This weakening has long been related to humidity (moisture), particularly being worse in areas of very high humidity. Unfortunately, most warehousing and much transport is under conditions of high humidity, and cyclic changes in humidity. This last is critical to large boxes with mobile, flowing contents. There is a nonending search for cartons which are light-weight, strong, of low bulk, weather proof, and are stackable without carton or bundle distortion.

In conjunction with the above subject matter, the prior art is illustrated by any of U.S. Pat. Nos. 3,407,987; 3,406,052; 3,411,689; and U.S. Pat. No. 3,796,307. U.S. Pat. No. 3,407,987 sets out a corrugated packaging material suitable for bundling. U.S. Pat. No. 3,406,052 discloses plastic coated corrugated fiberboards and methods for making this material. The corrugated flute is here coated on one or two sides with the plastic. U.S. Pat. No. 3,411,689 sets out a reinforced corrugated paperboard carton material and carton. In this instance, a strong non-bulging carton is formed, but it entails the use of a thermoplastic material for strengthening. Further, for strength, the container is quite massive. Thick layers of paperboard are necessary to produce a non-bulging side wall when stacked. U.S. Pat. No. 3,796,307 suggests the use of a heat shrinkable polymeric film adhesively bond to the flutes of the corrugated material.

Regarding the prior art mentioned above and which is incorporated in toto herein by reference, the problem of dealing with varying humidity (moisture) conditions has not really been recognized much less an effective solution therefor in conjunction with storing and handling corrugated packages. The present invention however, does provide a solution for this problem and overcomes some of the prior art disadvantages.

Accordingly, one object of the present invention is to provide a moisture stabilized package.

Another object of the present invention is to provide a package comprising a multi-cell container.

Another objective is to provide a process for the production of this package with efficiency of materials, labor, and energy.

A still further object of the present invention is to provide a package which has substantial stability in nonconditional storage and effectively reduces sidewall bulge.

Another object of the present invention is the provision of a corrugated container of high strength, but of a low weight and bulk and stackable for storage.

Figure 1:
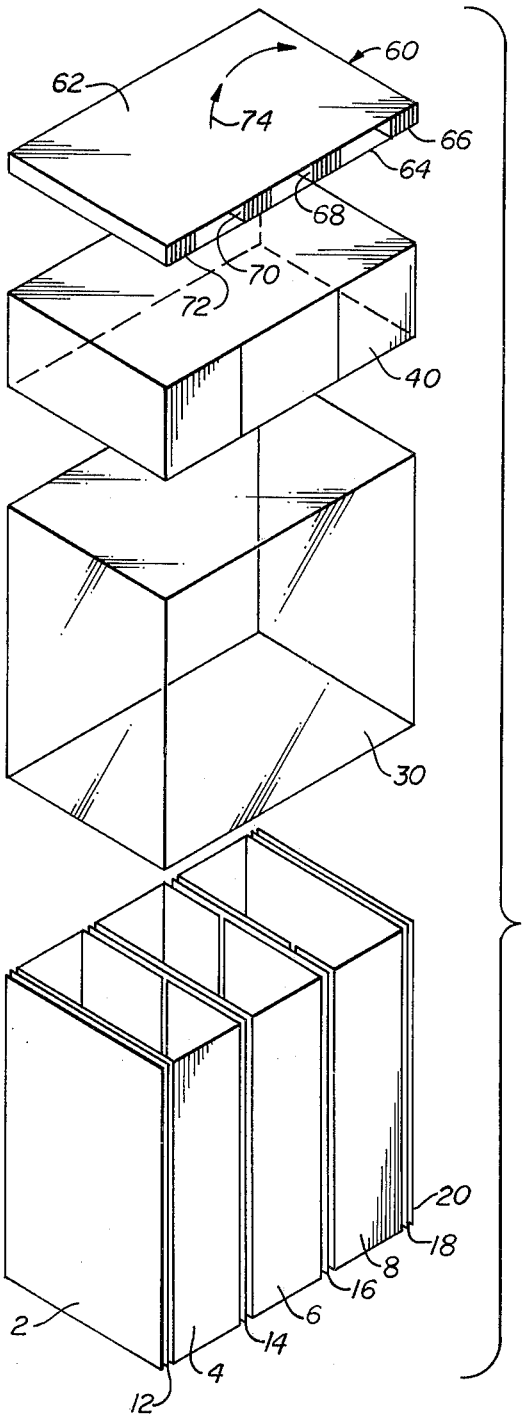
FIG. 1 is a perspective view of the present invention with the individual components (including a pallet) of the package in disassembled form with no cover shown.

Referring to FIG. 1, there is shown package 2 in disassembled form. Package 2 as shown comprises multi-cell containers 4, 6 and 8, without any bottoms, having a series of pads 10, 12, 14, thereto. It is to be understood that the term pad as used herein means a similar or dissimilar material as contrasted to that material used for the cell walls and tray and which acts at least partially to strengthen the side walls of said cells. Furthermore, these pads are substantially the same size as the cell walls with which they are adjacent thereto; however such pads are not critical to the construction of this package.

Cells 4, 6 and 8 have only side walls and no bottoms. The combination multi-cell unit is so constructed that it can be slightly compressed in order to fit the polymeric film 30 (also referred to herein as shroud) tightly therearound. This facet of the application of the polymeric film (shroud) around the multi-cell container is more fully described hereinafter. However, it is understood that this film encompasses only the multi-cell container. It has been found that one of the unique features of the present invention and critical features thereof is the utilization of only the film around the multi-cell container and not around the cover 90. It has been found that due to the density of water vapor, it is displaced by air if air currents are absent. The cover, without the film therearound and preferably a corrugated one, on the unit acts as a membrane, allowing water vapor to displace upward and blocking air currents. Thus, when the sides and bottom space of the multi-cell unit, only, are encompassed by said film, the moisture is removed from said unit through this cover-membrane. Thereafter, the moisture level in the multi-cell unit or container remains static regardless of the outside varying humidity conditions.

The cover 90 (FIG. 2) is so designed to provide a "snug" fit with the uppermost portion of the multi-cell container (unit). This cover is also provided with at least one hole (vent), not shown, in order to permit the escape of the moisture from said container.

While the multi-cell container, polymeric film (shroud) and cover are shown in rectangular form, it is within the scope of the present invention that other forms or configurations, e.g. square, may be used.

FIG. 1 shows another facet of the present invention, i.e. a tray 40 which is placed over the lower portion of the multi-cell container-film unit in order to provide protection of the film at the point of greatest liability to damage.

FIG. 1 also shows another facet of the present invention, i.e. a pallet 60 which comprises two substantially parallel rectangular members (decks) 62 and 64 with a series of stringers 66, 68, 70, and 72, preferably corrugated, which are positioned therebetween and substantially located beneath the four laminated vertically extending cell walls. Preferably both the decks and stringers are made from, respectively, corrugated sheets and strips.

Figure 2:
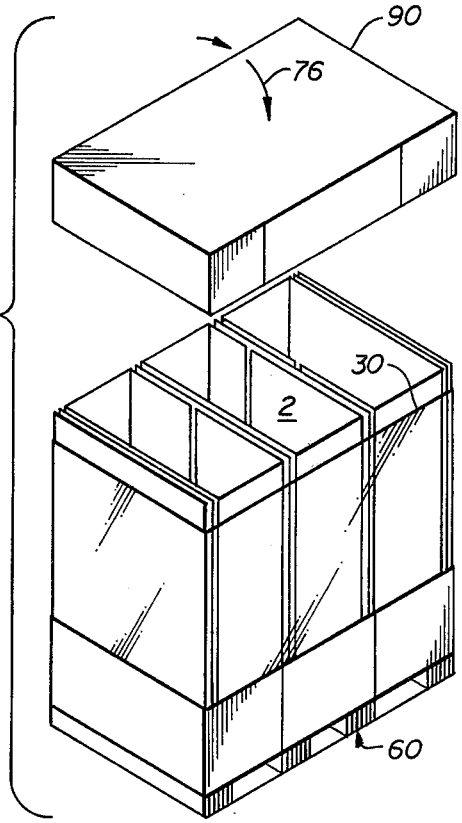
FIG. 2 is another perspective view of the present invention with the package partially assembled and situated on a pallet.

With reference to FIG. 2, there is shown the multi-cell container having the polymeric film (shroud) therearound. The arrows 74 and 76 in FIGS. 1 and 2 respectively, show the inversion of the overall pallet, and multi-cell container; however, cover 90 is now in position over the container for closure thereof after filling.

Figure 3:
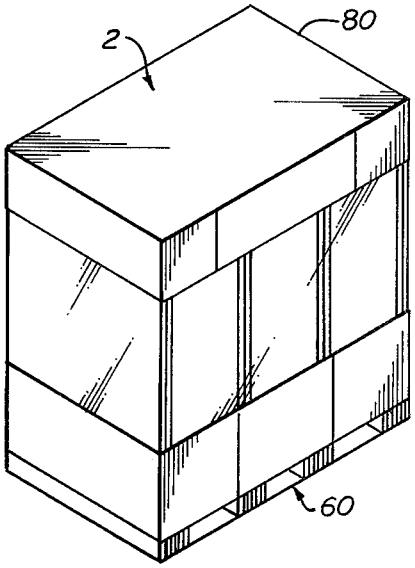
FIG. 3 is a perspective view of the completely assembled package with cover and tray and which is positioned on a pallet.

FIG. 3 shows the novel package 2 in its assembled form and situated on pallet 60.

While the drawing shows the use of three separate cells to constitute the multi-cell container, it is within the scope of the scope of the present invention to have more, e.g. 4, 5 and 6, cells if one so desires. Furthermore, two cells could be used. However, it is a preferred embodiment to use three cells.

Regarding the materials of construction, it is to be understood that these are not critical; however, it is preferred that such materials be corrugated.

The corrugated material may be of any type and will depend on the substance to be packaged and the protection required. The material may be of paper, paperboard, a combination of paper and plastic or paperboard and plastic. In a preferred and most useful embodiment, the corrugation is a standard paperboard of A, B or C designation. A-corrugation has approximately 36 flutes per foot, B-corrugation has approximately 52 flutes per foot, and C-corrugation has approximately 42 flutes per foot. The fluting material may range in thickness from 0.005 inch to 0.02 inch, depending on the package requirements. A preferred thickness is 0.009 inch. The pads are either adhesively bonded to the sidewalls using a standard adhesive such as starch or some other special purpose adhesive.

The polymeric film (shroud) may consist of any suitable material which accomplishes the desired end result. Such film may be either heat shrinkable or non-heat shrinkable. In the latter case, there is no requirement for the use of a shrink oven. The film in a preferred embodiment is a polyolefin and preferably polyethylene. It is to be understood that other types of materials, e.g. within the subgeneric categories of plastics, themoplastics, resins and the like, can be employed. The thickness of the film is not critical to the present invention and may range from about 2 mils to about 30 mils, preferably from about 4 mils to about 10 mils. Where one so desires, a heat-shrinkable variety of polymeric film may be employed; however, this is not critical to the present invention. It is to be understood that the term "heat-shrinkable" means any of the conventional uniaxially oriented polymeric films which on the application of heat are shrunk to a decreased surface area. Such films comprise oriented polyolefinic films such as polyproplyene, polyethylene, polyisopropylethylene and polyisobutylethylene. Other exemplary films are polystyrene, polyethylene terephthalate, polyethylene-2,6-naphthalate, polyethylene 1,5-naphthalate, polytetramethylene-1,2-dioxybenzoate, polyhexamethylene adipamide, polyhexamethylene sebacamide, polycaprolactum, polyvinylchloride and polymethylmethacrylate. Also included are polymers of alpha monoolefinically unsaturated hydrocarbons with organic compounds having polymer producing unsaturation such as is present in butene, vinyl acetate, vinyl stearate, vinyl formate, methyl acrylate, 2-ethyl hexyl acrylate, acrylic acid, isoprene, butadiene acrylamide, methacrylic acid, ethyl acrylate N-methyl-n-vinyl acetamide and the like. This list is illustrative of the types of polymeric films known in the art and is not an exhaustive citation of heat-shrinkable polymeric films. Others are known to the art and exhibit varying degrees of shrink on heating, and are useful in and a part of this invention.

In the conjunction with the use of heat shrinkable polymeric films, the process of heat-shrinking the film is essentially that of subjecting the film to a temperature wherein by elastic memory the film loses its stretched orientation. The heat in such instance can be supplied by radiation, conduction or convection or any combination. In one technique, the multi-cell unit can be conveyed through a tunnel containing lamps with a high infrared emission. In another method, warmed air is blown on the multi-cell unit shrinking the film. In general, techniques and equipment for heat shrinking are well known and any of these can be adapted for use with this type film.

EXAMPLE

In order to demonstrate the present invention, a package and pallet were constructed and tested as described hereinafter.

The container fabricated measures 29½"×46½"×50" high, overall. It consists of three cells, 14½"×29" I.D.., laminated together with pads and braced with two additional pads on each outer end wall. This total assembly is made from 500 pounds Mullen test double wall (D/W). It is partially erected in a floor mounted jig and covered, bottom to top, with a moisture barrier. All corrugations lie vertically, and lamination is over 100 percent of contacting surfaces. The moisture barrier is a shroud of polyethylene, (75"×60"), 6–8 mils thick, made from a tubing 75" wide, gusseted 15" deep on each edge, and sealed/perforated in 60" lengths. It is supplied in roll form, 100 bags per roll. The roll is lifted by a hoist to a position above box assembly and the first bag is pulled down and over the partly opened container. The container is erected completely, tightening the film, and is held erect in the floor jig. The tray and pallet assembly is placed on the container and it is inverted. The tray is designed to fit the unit snugly. It protects the film barrier at the point of greatest liability to damage and encompasses the container with its score lines. Its dimension is 30"×47" I.D., with a 15" depth. The material is 500 pounds D/W (69-26B-69-33C-69) and corrugations lie in the length direction. It is assembled with glue and stitching and no taper is allowed. An all-fiber pallet is made from non-test corrugated strips and two corrugated sheets for top and bottom decks. It is furnished ready-to-use and a barrier is included to prevent absorption of moisture from floors. Four stringers, 5"×30"×2¼" tall, are built from non-test board. These boards are sandwiched to 5" thickness and 30" width. Two and one-fourth inch stringers are sawed from these blocks to give 2¼" flute columns for support. These stringers are dipped (¼" of flute ends, only) into contact glue. The facings have contact glue applied in the proper area and the pallet assembled by pressure. The four stringers are located beneath the four laminated cell walls and exceed the walls in strength. The pallet fabricated is coated with dextrin glue above each stringer and the tray is attached with four pieces of strapping tape or with four "Box-Lox" staples. This assembly is placed over the shrouded container, which is then inverted. The cover fabricated is 30"×47½"×10" deep and is made from 350 pound D/W, (69-26-42-26-42). The cover is scored so that the 69 pound liner is outermost. Ventilation hand holds can be cut into the top at each end. This is to allow the easy escape of some 6–10 pounds of water when the container is loaded. Side vents close when the cap is pressed down. Top vents can be taped closed, if desired.

Utilizing the above containers, covers, trays, and pallets, several containers were packed with freshly produced butyl rubber. Each cell was loaded with 1,125 pounds of such butyl rubber, the three cell containers covered, the packages double stacked and a three thousand weight was placed atop each. These packages were subjected to varying natural humidity conditions in Houston, Tex. over the next three years. Thereafter, the packages were unstacked and inspected. These packages closely compared to those packed two or three days previously and the deflection was only in the range of one and one-half (1½) inch on all packages after three years of this heavily loaded storage test. Deflection was less than 50 percent of that shown by a group of standard corrugated boxes, without the polymeric film, packed for three months and not top loaded.

The uniqueness of the present invention package can thus readily be seen. The summarized observations of these tests are (1) the novel package loses strength slowly as compared to other standard corrugated boxes; (2) after a month of cyclic humidity, the novel package is roughly twice as strong as the standard box; and (3) the moisture content of the novel package remains closely constant. Thus, the advangages of the present invention can readily be seen.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An improved-strength-retaining moisture-stabilized package comprising in combination a container prepared from corrugated standard paperboard having peaks and flutes said container having four side walls, a closed bottom and an open top with a polymeric covering encompassing said four walled exterior surfaces and the exterior of said bottom portion of said container, and a water vapor permeable cover for covering said top open portion of said container said cover being prepared from standard paperboard having high porosity whereby said cover permits water vapor to be displaced upwardly from the interior of said container to pass through said cover and said polymeric covering prevents air currents from passing through the interior of said container, thereby resulting in a moisture-constant state within the interior of said package.

2. A storage unit for the containment of bulk chemicals in varying humidity conditions and which comprises a pallet which comprises a top and a bottom deck prepared from at least a partially corrugated first material having peaks and flutes and which decks are substantially parallel to each other and a series of stringers which connect said decks and which are prepared from at least a partially corrugated second material, with the proviso that said stringers each lie in a separate plane which is perpendicular to the parallel planes of the top and bottom decks and are proofed against water resorption by the use of waterproof contact cement to bond said stringers and said decks; and positioned on top of said pallet at least one package comprising a multi-cell container prepared from at least a partially corrugated third material having peaks and flutes, a polymeric film encompassing the outermost peripheral side wall and bottom portion of said container and a cover being prepared from standard paperboard having high porosity whereby said cover permits water vapor to be displaced upwardly from the interior of said container to pass through said cover and said polymeric covering prevents air currents from passing through the interior of said container, whereby resulting in a moisture-constant state within the interior of said package.

3. A process of improving the long-term moisture resistance of a moisture permeable standard corrugated paperboard six-sided container, one side being a removable cover for said container, which comprises in combination the steps of:

(a) providing a polymeric covering about the five non-cover sides of the container; and (b) placing said cover on top of said container, said cover being prepared from standard paperboard, having high porosity whereby said cover permits water vapor to be displaced upwardly from the interior of said container to pass through said cover and said polymeric covering prevents said air currents from passing through the interior of said container, thereby resulting in a moisture-constant state within the interior of said package.

4. A process according to claim 3 wherein said container has multiple internal cells.

5. A process according to claim 3 wherein a moisture laden bulk material is loaded into said container before said cover is placed in position and excess water vapor is immediately vented off through a vent provided in said cover.

6. A process according to claim 5 wherein said bulk material is butyl rubber and said polymeric cover is polyethylene film.

7. A process according to claim 5 wherein said vent is sealed off after venting.

8. A process according to claim 7 wherein vent is sealed off immediately after venting.

9. A process according to claim 3 wherein said polymeric cover is in the form of a shroud placed around said five sides.

10. A process according to claim 3 wherein said polymeric cover is coated on the five non-covered sides.

11. The process according to claim 3 wherein said polymeric covering is a heat shrinkable film.

12. The process according to claim 3 wherein said polymeric film is a non-heat shrinkable film.

* * * * *